United States Patent [19]

Bailey

[11] 4,178,118

[45] Dec. 11, 1979

[54] BUNDLE SQUARING MACHINE

[76] Inventor: Peter E. Bailey, 96 Broadwater Dr., Saratoga, Australia

[21] Appl. No.: 858,239

[22] Filed: Dec. 7, 1977

[30] Foreign Application Priority Data

Dec. 14, 1976 [AU] Australia ..... 8486/76

[51] Int. Cl.[2] ..... B65G 47/26

[52] U.S. Cl. ..... 414/28; 193/35 SS; 198/434; 198/457; 271/221

[58] Field of Search ..... 214/6 S; 271/221, 222, 271/236, 238; 198/411, 412, 413, 416, 434, 457; 193/35 A, 35 SS, 36

[56] References Cited

U.S. PATENT DOCUMENTS

| | | | |
|---|---|---|---|
| 2,086,160 | 7/1937 | Gotthardt et al. | 193/35 A X |
| 2,708,863 | 5/1955 | Payne | 214/6 S X |
| 2,805,757 | 9/1957 | Rapley | 214/6 S X |
| 2,942,717 | 6/1960 | Raynor | 198/434 X |
| 2,993,583 | 7/1961 | Sykes | 198/457 X |
| 3,189,156 | 6/1965 | Hyer et al. | 198/416 X |
| 3,265,186 | 8/1966 | Burton | 193/35 A X |
| 3,343,644 | 9/1967 | Kljuchnikov et al. | 193/35 A X |

FOREIGN PATENT DOCUMENTS

| | | | |
|---|---|---|---|
| 1247948 | 8/1967 | Fed. Rep. of Germany | 193/35 A |

*Primary Examiner*—James L. Rowland

*Attorney, Agent, or Firm*—Nilsson, Robbins, Dalgarn, Berliner, Carson & Wurst

[57] ABSTRACT

A bundle squaring machine suitable particularly for squaring a bundle of cartons in readiness for strapping. The machine includes a conveyor system for conveying a bundle of randomly orientated stack of articles into a squaring zone, where the stack is squared-up laterally and fore and aft. While in the squaring zone, side squaring arms close in a lateral direction against the sides of the bundle, and a pusher device moves the bundle longitudinally forward against a pair of spring biased rollers which contact the leading edge of the bundle. Following a period of contact between the leading edge of the bundle and the rollers, the rollers are pivoted clear of the bundle and, thereafter, the side squaring arms move back to their initial position. During the squaring operation the conveyor system is halted, the bundle being advanced by the pusher device during this period, and following the squaring operation, the pusher device is retracted below the level of the conveyor system. An article feed diverter is also provided for use in conjunction with the squaring machine.

10 Claims, 11 Drawing Figures

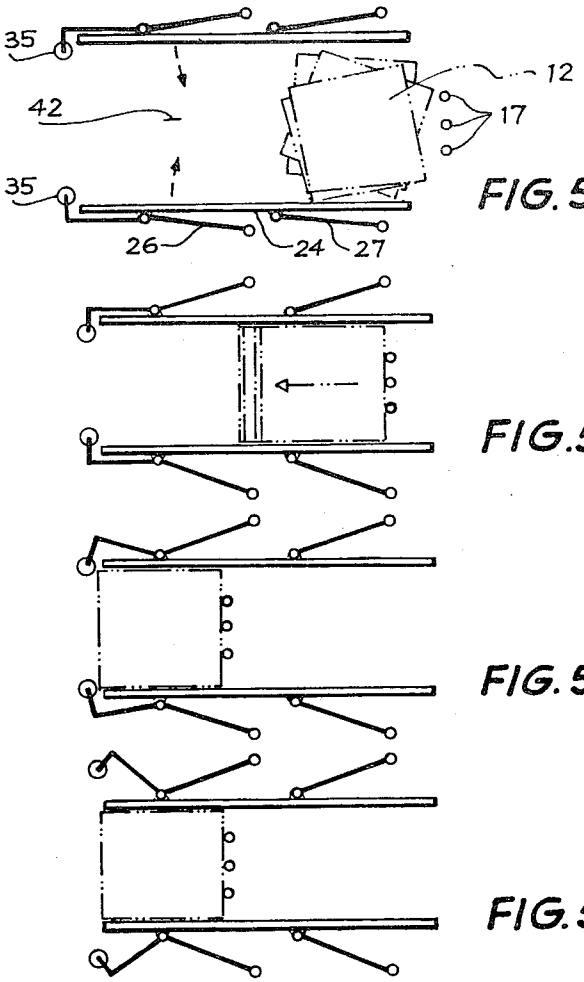
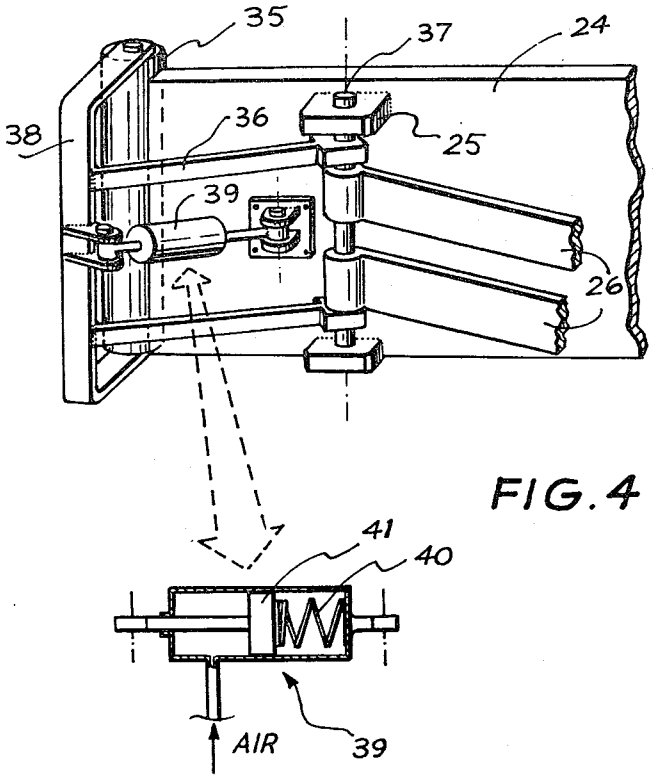
FIG. 4

BUNDLE SQUARING MACHINE

FIELD OF THE INVENTION

This invention relates to a machine which is suitable for use in squaring bundles of articles. The machine may be used for squaring bundles of cartons and is herein described in terms of such usage. However, it is to be understood that the machine may be used for squaring other articles which are stacked one upon the other to form a bundle.

In a typical carton producing plant, stacks of flat form cartons are delivered to a squaring machine from a preceding carton production line, with individual cartons in each stack being randomly orientated to a certain extent. Each stack of cartons is squared-up to a neat bundle in the machine, and then passed to a strapping machine where the squared bundle is strapped with one or more bands of a heat sealable plastics material.

DESCRIPTION OF THE PRIOR ART

Bundle squaring machines per se are well known and take various forms. One such machine, which is thought to be the most closely related to that now developed by the inventor, is manufactured by Ampag GmbH of Cologne, West Germany.

The Ampag machine comprises a series of horizontal driven rollers which transport a bundle of cartons in a longitudinal direction into, through and from a squaring zone. Whilst in the squaring zone, side squaring arms close onto the bundle in a lateral direction to square-up the sides of the bundle and, at the same time, an overhead pusher fork pivots downwardly against the trailing end of the bundle. The pusher fork then functions to push the bundles of cartons forward against vertically disposed rollers which are located adjacent the leading edge of the side squaring arms, the rollers being spring loaded to normally locate just inside the line of the side squaring arms and to inhibit (but not prevent) forward movement of the bundle. The action of the pusher fork moving the bundle longitudinally forward against the vertically disposed rollers results in squaring-up of the leading and trailing ends of the bundle, after which the side squaring arms (together with the vertically disposed rollers) and the pusher fork move away from the bundle and the squared bundle is then carried forward on the horizontal rollers.

SUMMARY OF THE PRESENT INVENTION

The squaring machine in accordance with the present invention is of the same general type as the Ampag machine above described, but it embodies features which distinguish over the Ampag type machine and which avoids problems inherent in that machine. These features are discussed in detail below.

In general terms, the present invention provides a bundle squaring machine comprising:

(a) a horizontally disposed conveyor system for conveying a bundle of articles in a longitudinal direction into and from a squaring zone of the machine, (b) a pair of parallel spaced-apart vertically disposed side squaring arms located above the conveyor system, the squaring arms being actuable to move toward one another in a lateral direction, whilst maintaining their parallel relationship, to co-act against a bundle of articles when located therebetween, and the squaring arms defining side borders of the squaring zone, (c) pusher means normally located in a retracted position below the level of the conveyor system intermediate the squaring arms, the pusher means being actuable to project upwardly above the level of the conveyor system and then to move in the longitudinal direction of the machine to push against a trailing end of a bundle of articles when located within the squaring zone, (d) vertically disposed rollers pivotably mounted one to each of the squaring arms at the leading end thereof, the rollers being spring biased to normally locate within side borders of the squaring zone to engage with a leading end of a bundle of articles when located within the squaring zone and when pushed longitudinally forward by the pusher means, (e) means actuable to cause the vertically disposed rollers to pivot away from their normal position and to a position outside of the side borders of the squaring zone following a period of contact between the vertically disposed rollers and a bundle when located within the squaring zone, and, (f) means actuable to halt movement of the conveyor system during actuation of the squaring arms and the pusher means.

In operation of the above described machine, a bundle of cartons is conveyed longitudinally forward toward the squaring zone and, as the bundle is about to enter the squaring zone, the bundle actuates a sensor. This then results in de-energization of the conveyor and actuation of the side squaring arms. Such arms then move in a lateral direction toward one another to act against the sides of the bundle and effect squaring-up of those sides. At the same time, the pusher means are actuated to project upwardly behind the trailing edge of the bundle within the squaring zone and then to move forward against the bundle. This has the effect of driving the bundle forward, between the side squaring arms, and into contact with the vertically disposed spring biased rollers at the leading end of the arms. Having contacted the vertically disposed rollers, the bundle is squared-up, fore and aft, being pushed against the rollers, but no crushing force is exerted on the bundle because the rollers are able to pivot back against the spring bias and thereby permit longitudinal advancement of the squared bundle. As the bundle is pushed forward between the rollers a further sensor is actuated, and this results in the following sequence of events:

(1) The vertically disposed rollers are caused to pivot away from contact with the leading end of the bundle. The drive to effect this pivoting movement is preferably delivered by way of a fluid operated piston.

(2) The side squaring arms are then caused to move away from the sides of the bundle, and at the same time, the forward movement of the pusher means is halted.

(3) The pusher means is then moved longitudinally backwards to its starting position and retracted so that a further bundle may enter the squaring zone.

(4) The conveyor system is restarted to carry the squared bundle forward and to convey a waiting bundle to the squaring zone. During restarting of the conveyor system the initial acceleration is kept sufficiently low as to prevent slippage between articles forming the squared bundle and to thus prevent the bundle from being "jerked out of square".

A particularly significant feature of the present invention as above defined resides in the provision of the means (the fluid operated pistons) which are actuated to cause the vertically disposed rollers to pivot away from the their normal position after being contacted by the leading end of the bundle. Such means counter the effect of the spring bias on the rollers and move the rollers away from the leading end of the bundle prior to movement of the side squaring arms away from the bundle. This action is made to occur in the machine to guard against any lack of synchronization in movement of the two side squaring arms, because if movement of the arms is not completely synchronized, the roller associated with a slower moving one of the arms will tend to bias forward and push the previously squared bundle out of square.

A further important feature of the present invention is the provision made for halting movement of the conveyor system whilst the bundle is being subjected to a squaring operation. This avoids any rapid acceleration being imparted to the bundle after completion of the squaring operation.

A further, preferred, feature of the present invention resides in the provision of an angle diverter which is suitable for use in conjunction with the bundle squaring machine as above defined. Such angle diverter permits bundles of randomly orientated articles to be delivered to the bundle squaring machine (or to any other machine) at an angle, usually approximately 90° to the longitudinal direction of movement of the conveyor system of the squaring machine.

The angle diverter, which may be alternatively referred to as an article feed diverter, comprises first and second conveyor systems, the first system comprising a drivable conveyor system and the second system comprising an idler conveyor system, the second conveyor system being orientated at an angle (usually 90°) to the first conveyor system and being movable selectably to a level above or below the first conveyor system, and a buffer device being located in the path of the second conveyor system.

In operation of the angle diverter mechanism, the second conveyor system would normally be aligned with an infeed conveyor arrangement, and the first conveyor system would normally be aligned with a bundle squaring machine. Then, with the second conveyor system elevated to a height above that of the first conveyor system, bundles of articles would be fed to the angle diverter from the in-feed conveyor and at a velocity corresponding to that of the in-feed conveyor. This velocity would be sufficient to cause the bundles to idle along the first conveyor system of the angle diverter until the bundles hit the buffer device, which acts as a shock absorber and prevents further foward travel of the bundles. When a bundle of articles impacts with the buffer device an associated sensor causes actuation of the second conveyor system, whereupon the first (driven) conveyor system engages with the bundle of articles and therefore causes such bundle to be carried forward, at right angles to its original direction of travel, toward the bundle squaring machine as above defined.

The invention will be more fully understood from the following description of a preferred embodiment thereof, the description being given with reference to the accompanying drawings.

BRIEF DESCRIPTION OF THE DRAWINGS

FIG. 4 shows a perspective view of the leading end of a side squaring arm of the bundle squaring machine, including a vertically disposed roller associated with the squaring arm, FIGS. 5*a* to 5*d* show sequential operations being performed on a bundle of articles in a squaring zone of the bundle squaring machine.

DETAILED DESCRIPTION OF THE INVENTION

Figures 1, 2:
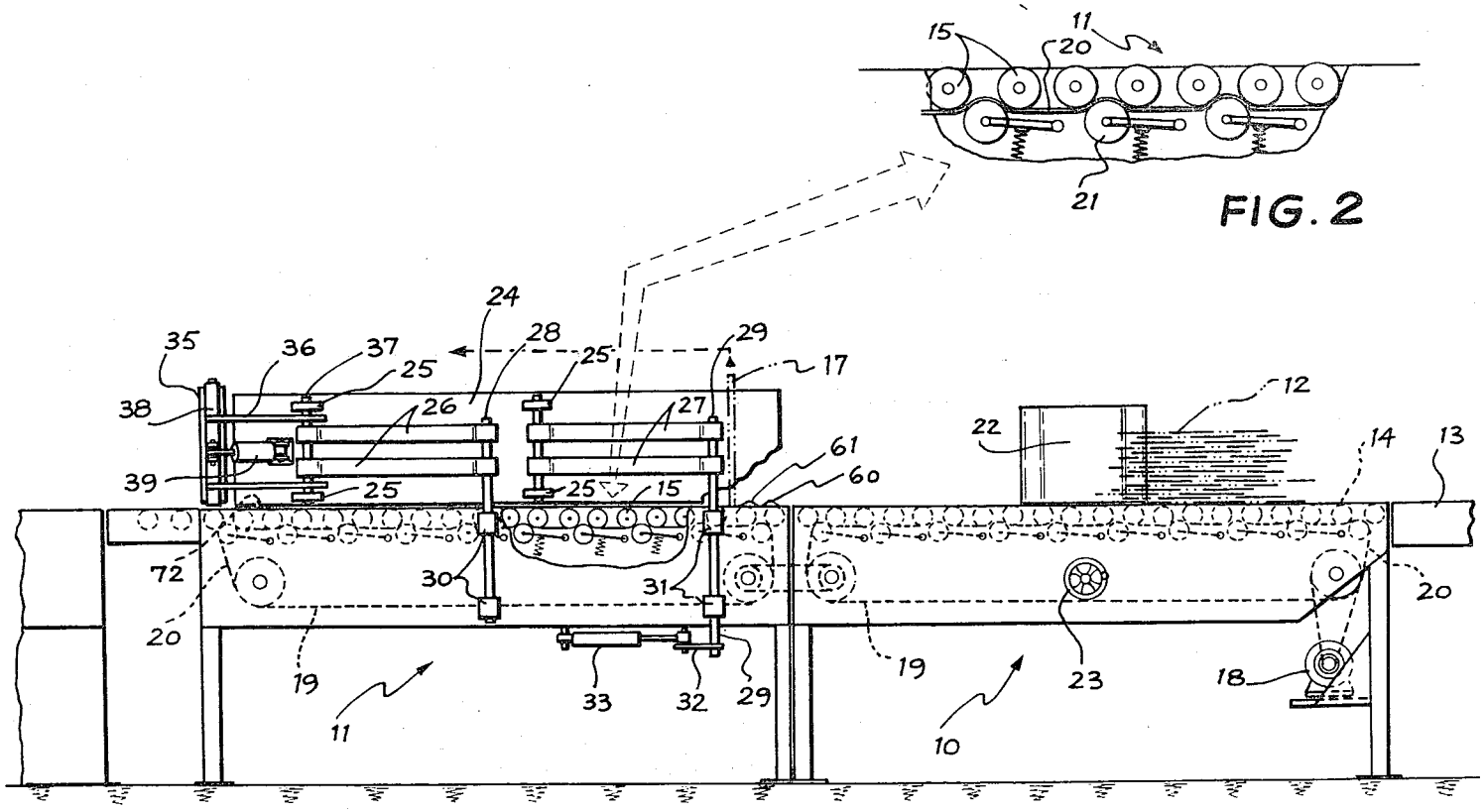
FIG. 1 shows a side elevation view of a bundle squaring machine, including a conveyor system associated therewith.
FIG. 2 shows a detail of the conveyor system of the machine illustrated in FIG. 1.

As is shown in FIGS. 1 to 4 of the drawings, the bundle squaring machine comprises two interconnected conveyor systems 10 and 11. The first conveyor system 10 is employed to convey a bundle 12 of randomly orientated flat-form cartons from a preceding stacking machine 13 to the second conveyor system 11 which forms a part of a bundle squaring zone.

The first conveyor system 10 has full width rollers 14, and the second conveyor system 11 has two-part rollers 15. The respective parts of each roller 15 are separated by a track 16 in which pusher fingers 17 (referred to below) are located. Alternative ones of the rollers 14 are coated with a material having a high co-efficient of friction.

The two conveyor systems 10 and 11 are powered by a single electric motor 18 and a chain/sprocket drive 19. Driving motion is transmitted to the rollers by friction belts 20 which pass below all of the rollers (see FIG. 2 for detail) and are pressed into frictional engagement with the rollers by pivotally mounted spring loaded pressure wheels 21. With this drive transmission to the rollers, if any object (such as a part of an operator's clothing) should jam in or wrap around one of the rollers, that roller will discontinue rotating (provided that the retarding force is greater than that of the driving friction force) to prevent any damage being sustained either by the machine or the interfering object.

A deflecting plate 22 is mounted to the first conveyor system 10 for the purpose of deflecting any misplaced bundle 12 into a path aligned with the center of the second conveyor system 11. The deflecting plate is provided with angled edges so that it can be used to cause turning of the bundle as it is conveyed past the deflecting plate. A hand wheel and lead screw arrangement 23 is provided to permit lateral adjustment of the position of the deflecting plate.

Located above the second conveyor system 11 are two spaced-apart, vertically disposed parallel side squaring plates 24. Each of the plates 24 is bearing mounted (at points 25) to pivotable parallel lever arm systems 26 and 27 which are respectively coupled to shafts 28 and 29. The shafts 28 are mounted for rotation in bearings 30 and the shafts 29 are similarly mounted in bearings 31, but the shafts 29 are further coupled, via lever arms 32, to pneumatic cylinders 33. When the cylinders 33 are actuated, the shafts 29 are turned to cause the lever mechanisms 27 to pivot inwardly. Then the squaring plates are moved inwardly and, because of the parallel relationship between the lever mechanisms 26 and 27, the squaring plates 24 move in a lateral direction and maintain their parallel relationship. This maintained relationship is indicated by the dash-dot lines in FIG. 3 and is described in greater detail below with reference to FIGS. 5*a* to 5*d*.

Each of the squaring plates 24 is fitted at its trailing end with a deflector plate 34.

A vertically disposed roller 35 is mounted via pivotable lever arms 36 to an axle 37 at the leading end of each squaring plate 24. The rollers are normally located inside the line of the squaring plates by a spring loaded piston/cylinder arrangement 39 which connects between each squaring plate and a bar 38 which bridges the lever arms 36. This arrangement is described in greater detail below, with reference to FIGS. 4 and 5.

Figure 3:
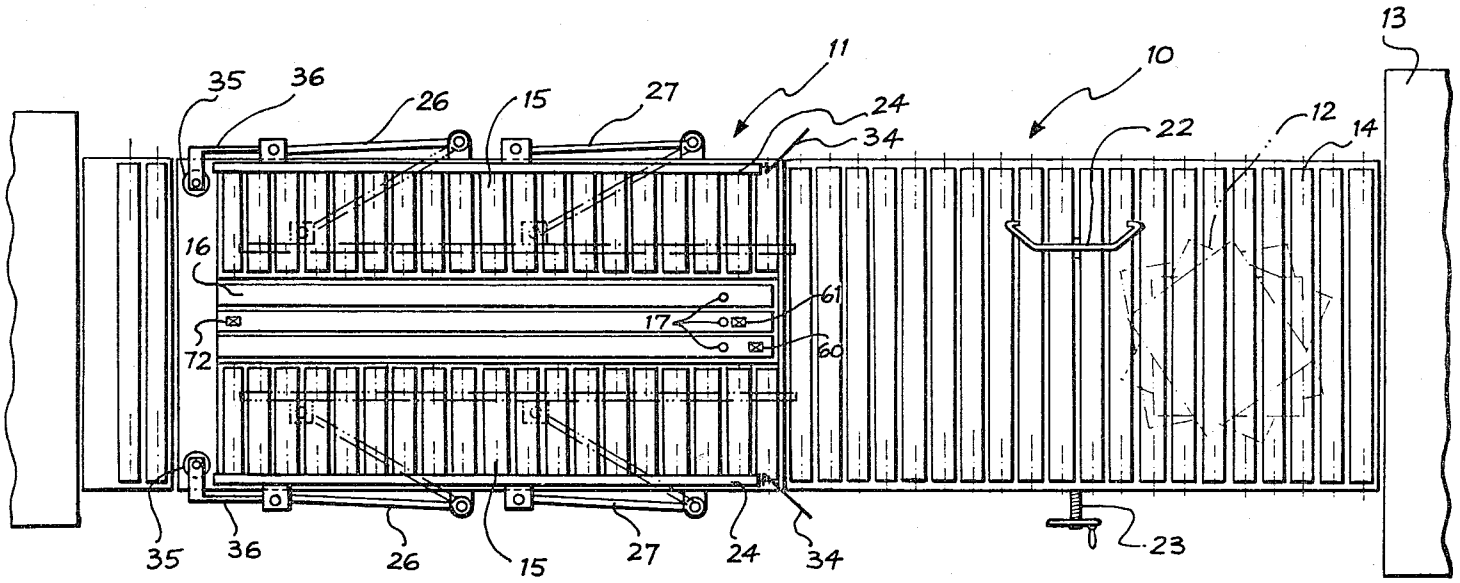
FIG. 3 shows a plan view (from above) of the machine illustrated in FIG. 1.

Located between the side squaring plates 24 is the track 16 which includes three parallel channels. Three pusher fingers 17 are normally located in a retracted condition at the trailing end of these channels, as shown in FIG. 3. The pusher fingers are coupled to a pneumatic cylinder (not shown) which is located below the second conveyor system 11 and which is actuable to drive the fingers upwardly, so that they project above the level of the conveyor system as shown by the dash-dotted lines in FIG. 1. A further pneumatic cylinder (also not shown) is provided to drive the fingers 17 longitudinally forward (when in their projecting condition) in the direction indicated by the arrows in FIG. 1. The three fingers 17 may be replaced by a single plate which operates in the same way and for the same purpose as the fingers.

Reference is now made to FIG. 4 of the drawings which details the arrangement of the rollers at the leading end of each of the side squaring plates 24. As above mentioned, the roller 35 is pivotally mounted to the squaring plate 24 by way of pivotal arms 36, and a pneumatic piston/cylinder arrangement 39 connects the rollers to the squaring plates.

The cylinder 39 houses a spring 40 which normally functions to bias the roller 35 to lie within the inside line of the squaring plate 24, but the biassing effect of the spring may be countered by applying fluid pressure to the piston 41, whereby the roller is driven out from its normal position to lie outside the line of the squaring plate. This operation is now described with reference to FIGS. 5*a* to 5*d*.

FIG. 5*a* shows a bundle of randomly stacked cartons 12 entering a squaring zone 42 between the side squaring plates 24. Whilst the bundle is entering the squaring zone 42, the three pusher fingers 17 remain in their retracted position below the level of the second conveyor 11. When the bundle 12 has passed over and cleared the pusher finger 17, pneumatic circuits are energized (in a manner to be hereinafter described) and the side plates 24 are moved in a lateral direction toward one another, so as to close on the sides of the bundle of cartons 12. At the same time the pusher fingers 17 are projected upwardly to locate behind the bundle. For the period during which the squaring plates 24 are in their open and closing positions, the rollers 35 at the leading end of the squaring plates are biassed inwardly.

When the side squaring plates 24 have moved inwardly to their maximum extent they co-act with the side walls of the bundles 12 to cause squaring-up of those side walls, as is shown in FIG. 5*b*. At the same time the bundle 12 is pushed forwardly in a longitudinal direction by the pusher fingers 17, this causing the leading end of the bundle to engage with the rollers 35. Because of the pushing force from the fingers and a retarding force exerted by the spring biassed rollers 35 the leading and trailing ends of the bundle are squared-up. During this fore and aft squaring operation the fingers 17 continue to move forward and to avoid crushing of the bundle the rollers 35 are pivoted away against the action of the spring bias. This is shown in FIG. 5*c* of the drawings.

Thereafter, a further pneumatic circuit is energized and the pneumatic piston/cylinder arrangement 39 associated with the rollers 35 causes the rollers to pivot away from the leading end of the bundle 12 in the manner described with reference to FIG. 4 and as shown in FIG. 5*d*. Following the stage shown in FIG. 5*d* the side squaring arms 24 return to their initial (rest) position, the pusher fingers 17 move longitudinally backwards to their initial position and then retract below the level of the second conveyor system 11, and the conveyor system 11 is restarted to move the squared bundle 12 of cartons forward into a strapping machine which is located ahead of the above described bundle squaring machine.

An important feature of the invention as above described is that, during the period of forward movement of the pusher fingers 17 against the bundle 12, the first and second conveyor systems 10 and 11 are stopped by disengaging a clutch, referred to below, and are not restarted until the sequential steps shown in FIGS. 5*a* to 5*d* are completed.

Figure 6:
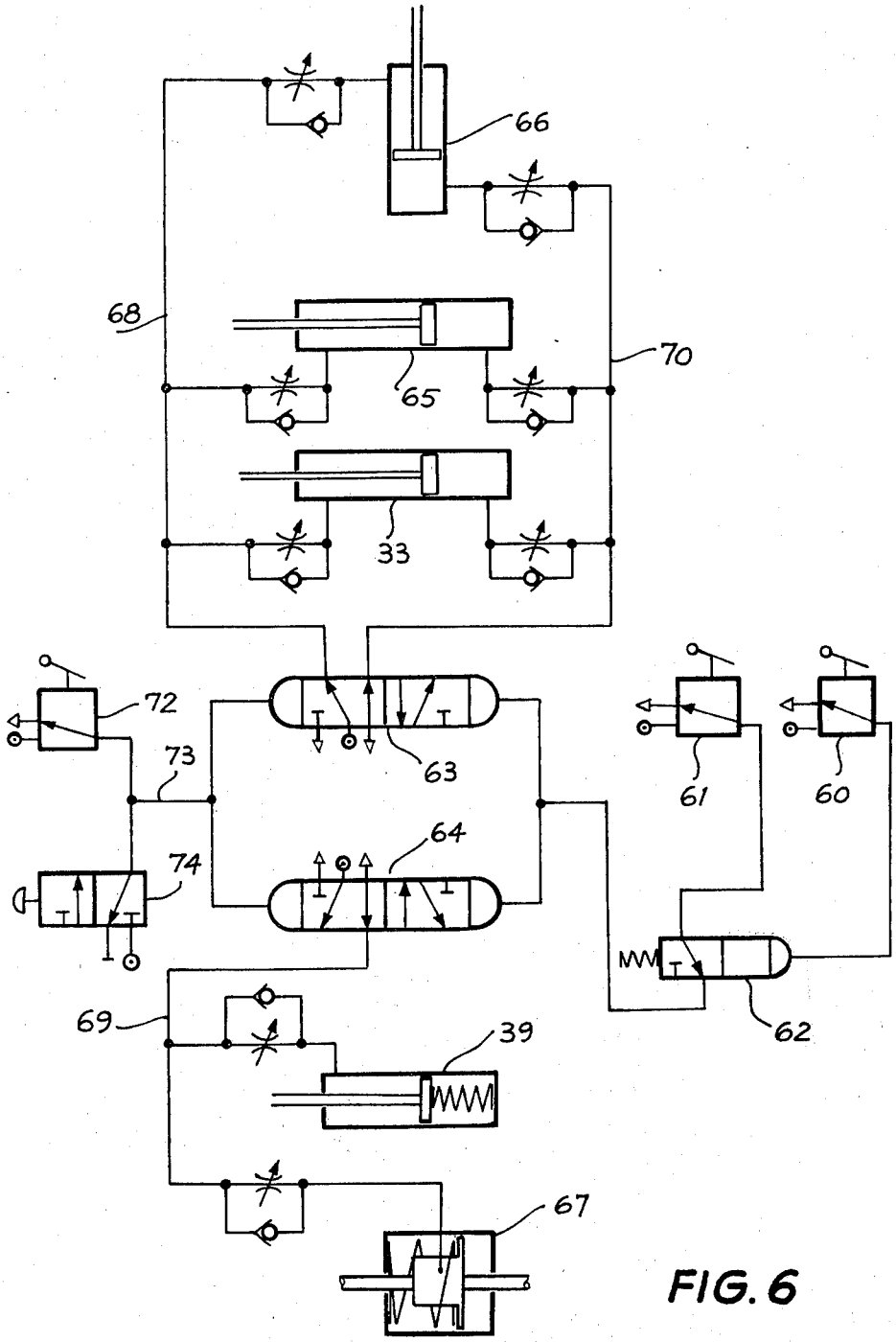
FIG. 6 shows an electro-pneumatic circuit associated with various elements of the bundle squaring machine.

Reference is now made to FIG. 6 of the drawings which shows a pneumatic circuit which is employed in conjunction with the bundle squaring machine as above described.

The circuit includes two pneumatic microswitches 60 and 61 which are located at the right hand end of the squaring zone as shown in FIG. 3 of the drawings. The switch 60 is the first one contacted by a bundle which is being conveyed toward the squaring zone and, when so contacted, the switch 60 causes a following spring loaded valve 62 to be activated to a valve-closed position. The switch 61 is then contacted as the bundle progresses further toward the squaring zone but, for as long as the bundle is in contact also with switch 60, pressurised fluid cannot pass through the valve 62 from the switch 61. However, when the bundle has been conveyed beyond switch 60, but still remains in contact with switch 61, pressure is released from the valve 62 and it returns to its normally open position. At this point in time, that is when the bundle has almost completely entered the squaring zone, the fluid pressure which passes via switch 61 and valve 62 is used to activate the following circuit.

Such circuit includes two detent valves 63 and 64. Valve 63 is coupled to a first double acting pneumatic cylinder 33 (see also FIG. 1) which serves to actuate the side squaring plates, to a second double acting pneumatic cylinder 65 which serves to drive the pusher fingers back and forth in the longitudinal direction, and to a third double acting pneumatic cylinder 66 which serves to extend and retract the pusher fingers above and below the conveyor.

Valve 64 is coupled to the spring loaded pneumatic cylinder 39 (see also FIG. 4) which serves to actuate the vertically disposed rollers, and to a pneumatic clutch 67 in the conveyor drive circuit.

In the circuit condition shown in FIG. 6, i.e., before a bundle passes over the switches 60 and 61, fluid pressure is applied via line 68 to cylinders 33, 65 and 66. Under this condition, the side squaring plates are held away from the squaring zone, the pusher fingers are held at the right hand end of their tracks (as shown in FIG. 3) and the fingers are held in their retracted position so as to permit entry into the squaring zone of a bundle. At the same time, the cylinder 39 and the clutch 67 are connected to atmosphere via line 69 and the valve 64. This enables spring biasing of the vertical rollers (as previously described) and drive transmission to the conveyor rollers.

When a bundle is conveyed into the squaring zone (i.e., when pressurised gas is delivered to the detent valves 63 and 64 via valve 62, as above described), the valves 63 and 64 are actuated. Valve 63 then delivers fluid to cylinders 33, 65 and 66 via line 70 and line 68 is connected to atmosphere. This results in the squaring plates being moved laterally toward one another, the pusher fingers being moved along their tracks toward the left hand end of the machine (as shown by the arrows in FIG. 1), and the pusher fingers being extended above the level of the conveyor rollers. The time taken for each of these functions is controlled by the adjustable restrictors shown located in the fluid lines connected to the respective cylinders.

During the same time interval over which the cylinders 33, 65 and 66 are actuated, the cylinder 39 and the clutch 67 are connected to the pressured supply. This results, initially, in disengagement of the clutch (halting the conveyor system) and, shortly later, in actuation of the cylinder 39. The belated actuation of the cylinder 39 effects pivoting of the vertical rollers at the leading end of the squaring arms after the rollers have been contacted by the advancing bundle.

When the bundle has been pushed beyond the vertical roller it contacts a further pneumatic microswitch 72 (see also FIG. 3) which is operated to apply fluid pressure to the valves 63 and 64 via line 73. This results in restarting of the conveyor system (i.e., clutch 67 is again engaged), and movement of the side squaring arms and pusher fingers back to their starting positions.

A manually operable control valve 74 is provided for overriding the effect of actuating the starting switches 60 and 61.

The switches 60, 61 and 72 may be replaced by photoelectric detectors or other similar proximity switching devices and other circuit adjustments be made as appropriate.

Figure 8:
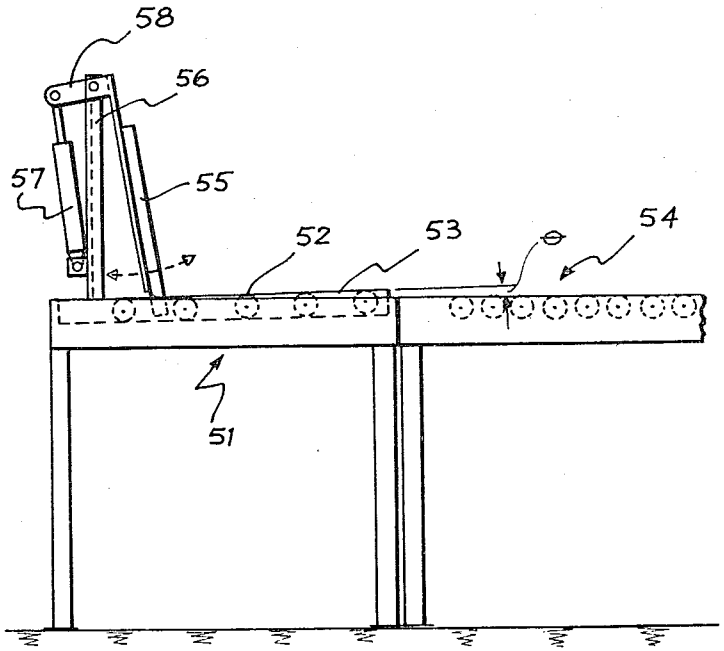
Figure 7:
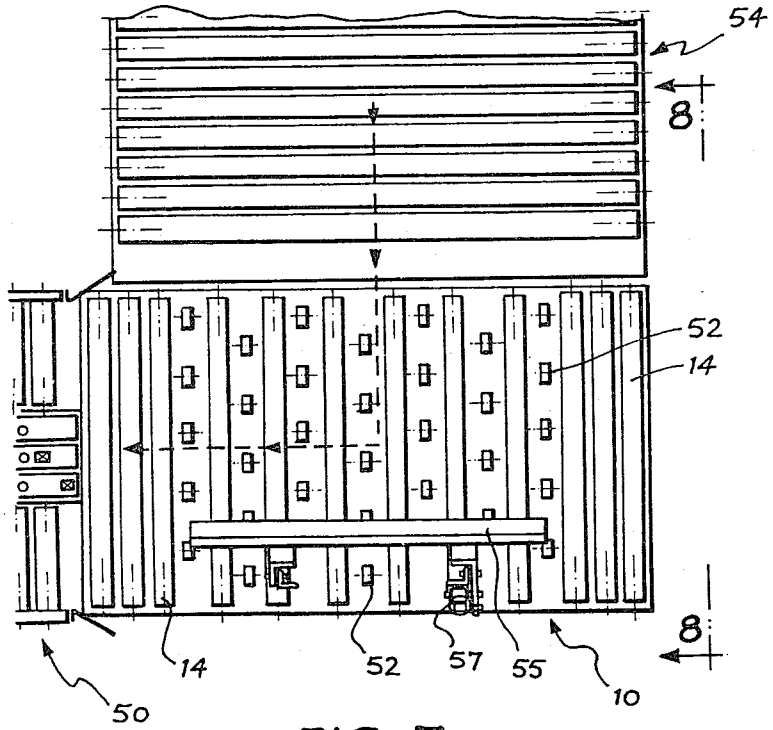
FIG. 7 shows a plan view (from above) of an angle diverter for use in conjunction with the bundle squaring machine, and, FIG. 8 shows an end elevation view of the angle diverter as seen in the direction indicated by arrows 8—8 of FIG. 7.

Reference is now made to FIGS. 7 and 8 of the drawings which show an angle diverter mechanism for use in conjunction with the bundle squaring machine previously described. The angle diverter is used to accommodate situations where the bundles must be fed to the bundle squaring machine at 90° from a preceding production line, such situation normally arising where insufficient factory space exists for a complete in-line system.

The angle diverter mechanism may be provided in addition to the first conveyor system 10 as above described or, as shown in FIGS. 7 and 8, it may be incorporated in the first conveyor system. Thus, as shown, the angle diverter mechanism comprises a first conveyor system 10 which is aligned with the squaring mechanism 50, the first conveyor system including a series of laterally extending rollers 14. The rollers 14 are driven in the manner above described with reference to FIGS. 1 to 3.

In addition to the driven conveyor system 10, the angle diverter mechanism includes a second conveyor system 51 consisting of an array of idler rollers 52 mounted to a subframe 53. The idler rollers are orientated at 90° C. to the driven rollers 14, in alignment with an in-feed conveyor system 54.

The sub-frame 53, together with the array of idler rollers 52, is mounted to a pneumatic piston/cylinder arrangement (not shown) which may be actuated either to lift the second conveyor system 51 to a level just above the first conveyor system 10 or to retract the second conveyor system 51 to a level below the first conveyor system 10. When in the elevated position, the sub-frame 53, together with the array of idler rollers 52, is inclined at a small angle $\theta$ to the infeed conveyor 54 and hence to the axis of the rollers 14 of the first conveyor 10 mechanism.

A buffer plate 55 is pivotably mounted to a post 56 which projects upwardly from the angle diverter mechanism, the buffer plate being aligned with the direction of feed of the second conveyor mechanism 51. A shock absorber 57 connects a lever arm 58 of the buffer plate 55 to the post 56, the shock absorber being provided to absorb kinetic energy possessed by bundles which pass from the in-feed conveyor 54 and impact with the buffer plate 55.

In operation of the angle diverter mechanism, bundles of articles (not shown) are conveyed along the infeed conveyor 54 and projected forward onto the idler rollers 52 of the second conveyor mechanism. During this operation the second conveyor mechanism 51 is elevated to a position above the level of the rollers 14 of the first conveyor system 10. Once deposited upon the rollers 52 of the second conveyor 51, the bundles travel forward along the rollers 52 until they impact with the buffer plate 55. Upon this happening a microswitch (not shown) is activated, by pivotal movement of the buffer plate, and the second conveyor mechanism is immediately retracted to its level below that of the first conveyor mechanism 10. As the second conveyor mechanism does retract, the bundle of articles carried thereby comes to rest on the rollers 14 of the first conveyor mechanism and these rollers 14 are then driven to convey the bundle in the direction toward the squaring machine 50.

Thereafter, the second conveyor mechanism 51 is again elevated to its original height in readiness to receive a further bundle of articles from the in-feed conveyor system 54.

I claim:

1. A bundle squaring machine comprising:

(a) a horizontally disposed conveyor system for conveying a bundle of articles in a longitudinal direction into and from a squaring zone of the machine, (b) a pair of parallel spaced-apart vertically disposed side squaring arms located above the conveyor system, the squaring arms being actuable to move toward one another in a lateral direction, whilst maintaining their parallel relationship, to co-act against a bundle of articles when located therebetween, and the squaring arms defining side borders of the squaring zone, (c) pusher means normally located in a retracted position below the level of the conveyor system intermediate the squaring arms, the pusher means being actuable to project upwardly above the level of the conveyor system and then to move in the longitudinal direction of the machine to push against a trailing end of a bundle of articles when located within the squaring zone, (d) vertically disposed rollers pivotably mounted one to each of the squaring arms at the leading end thereof, the rollers being spring biased to normally locate within side borders of the squaring zone to engage with a leading end of a bundle of articles when located within the squaring zone and when pushed longitudinally forward by the pusher means, (e) means actuable to cause the vertically disposed rollers to pivot away from their normal position and to a position outside of the side borders of the squaring zone following a period of contact between the vertically disposed rollers and a bundle when located within the squaring zone, and, (f) means actuable to halt movement of the conveyor system during actuation of the squaring arms and the pusher means.

2. A machine as claimed in claim 1 wherein the conveyor system comprises a series of laterally extending rollers, each roller contacting a common drive belt in frictional engagement and the drive belt being held in contact with the rollers by spring loaded idler rollers.

3. A machine as claimed in claim 1 wherein each of the side squaring arms is mounted above the conveyor system by a pair of parallel lever arms, the lever arms associated with each side squaring arm being pivotable on pivot shafts and one said pivot shaft associated with each pair of lever arms being drivingly coupled to a fluid actuator.

4. A machine as claimed in claim 1 wherein said means which are actuable to cause the vertically disposed rollers to pivot comprise a fluid actuated piston/-cylinder device connecting a support arm for each of the vertical rollers to the associated side squaring arm, the piston/cylinder devices each incorporating a spring which acts, in the absence of a pressurized fluid supply, to provide the spring bias normally applied to the vertical rollers.

5. A machine as claimed in claim 1 and including at least one sensor arranged to sense a bundle entering the squaring zone and to initiate:

(a) halting of the conveyor system, (b) upward projection of the pusher means, (c) movement toward one another of the side squaring arms, and, (d) advancement of the pusher means toward the leading end of the side squaring arms, and further including at least one sensor arranged to sense a bundle being pushed from the squaring zone and to initiate:

(e) retraction of the vertically disposed rollers away from their said normal position and to said position outside of the side borders of the squaring zone, (f) outward movement of the side squaring arms, (g) restarting of the conveyor system, and (h) retraction of the pusher means to the initial position thereof.

6. A machine as claimed in claim 1 and including a deflector device mounted to the conveyor system, the deflector device being arranged to impede and thereby turn a bundle during its movement with the conveyor toward the squaring zone.

7. A machine as claimed in claim 6 wherein the deflector device is adjustably positionable in the lateral direction of the conveyor system.

8. A machine as defined in claim 1 further comprising a bundle feed diverting mechanism mounted in feeding connection with the machine, the feed diverting mechanism comprising a first conveyor system which is mountable in alignment with said horizontally disposed conveyor system and a second conveyor system, the first conveyor system comprising a drivable conveyor system and the second system comprising an idler conveyor system, the direction of the second conveyor system being orientated at an angle to that of the first conveyor system, the second conveyor system being movable selectively to a level above or below the first conveyor system, and a buffer device being located in the path of the second conveyor system.

9. A machine as claimed in claim 8 wherein the buffer device comprises a generally rectangular upstanding plate which extends for substantially the width of the second conveyor system adjacent one end thereof, the plate being pivotably mounted about an axis parallel to the plane of the second conveyor system and a shock absorber device being coupled to the plate to inhibit pivotal movement thereof.

10. A machine as claimed in claim 8 wherein the direction of the second conveyor system is orientated at an angle of 90 degrees to that of the first conveyor system, and wherein the plane of the second conveyor system in the longitudinal direction thereof is inclined at a small angle to the lateral plane of the first conveyor system.

* * * * *